US011441790B2

(12) United States Patent
Choi et al.

(10) Patent No.: US 11,441,790 B2
(45) Date of Patent: Sep. 13, 2022

(54) AIR CONDITIONER

(71) Applicant: LG Electronics Inc., Seoul (KR)

(72) Inventors: Seokho Choi, Seoul (KR); Jeongtaek Park, Seoul (KR); Taehun Lee, Seoul (KR); Jinwook Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 303 days.

(21) Appl. No.: 16/547,070

(22) Filed: Aug. 21, 2019

(65) Prior Publication Data

US 2020/0063988 A1 Feb. 27, 2020

(30) Foreign Application Priority Data

Aug. 21, 2018 (KR) ..... 10-2018-0097440

(51) Int. Cl.

| | |
|---|---|
| ***F24F 1/0011*** | (2019.01) |
| ***F24F 1/0025*** | (2019.01) |
| ***F24F 1/0035*** | (2019.01) |
| ***F24F 1/0059*** | (2019.01) |
| ***F24F 1/38*** | (2011.01) |

(Continued)

(52) U.S. Cl.

CPC ..... *F24F 1/0011* (2013.01); *F24F 1/0025* (2013.01); *F24F 1/0035* (2019.02); *F24F 1/0059* (2013.01); *F24F 1/38* (2013.01); *F24F 1/0047* (2019.02); *F24F 1/0057* (2019.02); *F24F 2221/28* (2013.01)

(58) Field of Classification Search

CPC ..... F24F 1/0011; F24F 1/0025; F04D 29/422; F04D 29/441

See application file for complete search history.

(56) References Cited

U.S. PATENT DOCUMENTS 5,127,238 A * 7/1992 Ichikawa ..... B60H 1/00871 415/53.1
5,944,481 A * 8/1999 Stone ..... F04D 29/441 415/53.1

(Continued)

FOREIGN PATENT DOCUMENTS

| | | |
|---|---|---|
| CN | 1176325 | 11/2004 |
| EP | 0819894 | 1/1998 |

(Continued)

OTHER PUBLICATIONS

Extended European Search Report in European Application No. 19192777.1, dated Jan. 20, 2020, 7 pages.

*Primary Examiner* — Christopher R Zerphey
(74) *Attorney, Agent, or Firm* — Fish & Richardson P.C.

(57) ABSTRACT

An air conditioner includes a housing that defines an air inlet and an air outlet, a heat exchanger, a blowing fan inside the housing, a lower guide configured to guide, toward the air outlet, air discharged to a rear side of the blowing fan and a lower side of the blowing fan, and an upper guide that is disposed vertically above the lower guide and that defines a discharge flow path with the lower guide. The discharge flow path extends from the blowing fan to the air outlet, and a cross sectional area of the discharge flow path increases toward the air outlet. The upper guide defines a curved surface that is disposed at a downstream end of the upper guide adjacent to the air outlet and that is convex toward the air outlet.

20 Claims, 10 Drawing Sheets

(51) Int. Cl.
*F24F 1/0047* (2019.01)
*F24F 1/0057* (2019.01)

(56) References Cited

U.S. PATENT DOCUMENTS

| | | | | |
|---|---|---|---|---|
| 7,517,185 | B2 * | 4/2009 | Hirakawa | F04D 17/04 415/53.1 |
| 8,006,510 | B2 * | 8/2011 | Miyamoto | F24F 1/0057 62/285 |
| 8,627,672 | B2 * | 1/2014 | Moteki | F24F 13/32 62/263 |
| 8,956,107 | B2 * | 2/2015 | Ohishi | F24F 13/082 415/121.2 |
| 9,011,092 | B2 * | 4/2015 | Eguchi | F04D 29/441 415/211.2 |
| 9,879,868 | B2 * | 1/2018 | Hirakawa | F24F 3/06 |
| 10,415,601 | B2 * | 9/2019 | Thawani | F04D 29/282 |
| 2005/0223732 | A1 * | 10/2005 | Kim | F24F 1/0011 62/298 |
| 2017/0227240 | A1 * | 8/2017 | Ikeda | F24F 1/0011 |
| 2020/0018493 | A1 * | 1/2020 | Shirota | F24F 1/0011 |

FOREIGN PATENT DOCUMENTS

| | | |
|---|---|---|
| EP | 1707892 | 10/2006 |
| EP | 2405206 | 1/2012 |
| KR | 10-2018-0010888 | 1/2018 |

* cited by examiner

AIR CONDITIONER

CROSS-REFERENCE TO RELATED APPLICATION

This application claims the priority benefit of Korean Patent Application No. 10-2018-0097440, filed on Aug. 21, 2018, the disclosure of which is incorporated herein by reference in its entirety.

TECHNICAL FIELD

The present disclosure relates to an air conditioner, and more particularly to an interior of an air conditioner.

BACKGROUND

An air conditioner may include a compressor for compressing a refrigerant, a condenser for condensing the compressed refrigerant, an expander for expanding the condensed refrigerant, and an evaporator for evaporating the expanded refrigerant. The air conditioner is a device that may heat or cool indoor air by flowing refrigerant through the aforementioned elements to control a temperature of the indoor air.

In some cases, the air conditioner may include an indoor unit having a heat exchanger for performing heat exchange of indoor unit, and an outdoor unit having a heat exchanger for performing heat exchange of outdoor air. The heat exchangers provided in the indoor unit and the outdoor unit may serve as an evaporator or a condenser according to circulation of refrigerant.

The indoor unit may be classified into a ceiling-mount type, a standalone type, and a wall-mount type according to an arrangement and structure of the indoor unit. The wall-mount indoor unit may be disposed on an upper side of an indoor wall surface, and have an air outlet formed therein to discharge heat-exchanged air toward a front lower side.

In some cases, the wall-mount indoor unit may have a discharge flow path formed toward a front lower side so as to guide air flowing in a blowing fan disposed in a rear upper side of an air outlet. In some cases, it may be difficult to discharge air through a long distance or discharge air upwardly through a long distance based on a wind direction of discharged air and a volume of air discharged by a vortex occurring in a discharge flow path.

In some examples, an air conditioner may include an air outlet opened toward a front lower side of a blowing fan and a discharge flow path continued to the air outlet. In the air conditioner, a wind direction of discharged air may be defined toward the front lower side of the blowing fan in which it may be difficult to discharge air through a long distance.

In some cases, an air conditioner may include a vane that generates a horizontal wind and that is disposed parallel to a floor or a ceiling surface. In such cases, a cross-sectional area of the discharge flow path may decrease toward a downstream of the discharge flow path, and a volume of air to be discharged through the air outlet may be reduced.

As discussed above, discharging a large volume of air through a long distance may be difficult in which a cooling operation may not be efficiently performed by an indoor unit placed in a large space.

SUMMARY

The present disclosure describes an air conditioner capable of discharging air by a long distance.

The present disclosure describes an air conditioner capable of ensuring a predetermined or more volume of discharged air.

Objects of the present disclosure should not be limited to the aforementioned objects and other unmentioned objects will be clearly understood by those skilled in the art from the following description.

According to one aspect of the subject matter described in this application, an air conditioner includes: a housing that defines an air inlet and an air outlet disposed vertically below the air inlet; a heat exchanger configured to exchange heat with air introduced into the housing through the air inlet; a blowing fan that is disposed inside the housing, that is disposed at an upper rear side of the air outlet, and that is configured to rotate about a rotational axis that extends in a left-right direction of the housing to cause air introduced through the air inlet to flow toward the air outlet; a lower guide configured to guide, toward the air outlet, air discharged to a rear side of the blowing fan and a lower side of the blowing fan; and an upper guide that is disposed vertically above the lower guide and that defines a discharge flow path with the lower guide. The discharge flow path extends from the blowing fan to the air outlet, and a cross sectional area of the discharge flow path increases toward the air outlet. The upper guide defines a curved surface that is disposed at a downstream end of the upper guide adjacent to the air outlet and that is convex toward the air outlet.

Implementations according this aspect may include one or more of the following features. For example, 2. The air conditioner of claim 1, wherein the lower guide may include: a lower guide-curved surface portion that defines a curved surface configured to guide, toward the air outlet, air discharged from the blowing fan toward the rear side of the blowing fan or the lower side of the blowing fan; and a lower guide-straight surface portion that defines a planar surface that extends from the lower guide-curved surface portion toward the air outlet. The upper guide may include: an upper guide-straight surface portion that defines a planar surface at an upstream side of the discharge flow path; and an upper guide-curved surface portion that extends from the upper guide-straight surface portion toward the air outlet and that defines the curved surface of the upper guide convex toward the air outlet.

In some implementations, the upper guide-straight surface portion may define a first inclination angle with respect to a horizontal line that extends in a front-back direction of the housing, and the lower guide-straight surface portion may define a second inclination angle with respect to the horizontal line, the second inclination angle being greater than the first inclination angle.

In some implementations, the upper guide-curved surface portion may have a first end that is adjacent to the air outlet and that is disposed vertically above a virtual horizontal plane that extends in a front-back direction of the housing. In some examples, the upper guide-curved surface portion may have a second end that is connected to the upper guide-straight surface portion and that is disposed vertically below the virtual horizontal plane.

In some implementations, the upper guide may include a plurality of protrusions that are disposed at an upstream side of the discharge flow path, that protrude from a surface of the upper guide toward the discharge flow path, and that are spaced apart from each other along a direction parallel to the rotational axis of the blowing fan. In some examples, the upper guide may define a plurality of grooves that extend along the discharge flow path and that are recessed inward from the surface of the upper guide. In some examples, the plurality of grooves may be disposed downstream of the plurality of protrusions along the discharge flow path.

In some implementations, a protrusion height of each of the plurality of protrusions with respect to the surface of the upper guide may be greater than a recess depth of each of the plurality of grooves with respect to the surface of the upper guide. In some implementations, two grooves of the plurality of grooves are arranged between two adjacent protrusions among the plurality of protrusions.

In some implementations, the upper guide may include: an upper guide-straight surface portion that defines a planar surface at the upstream side of the discharge flow path; and an upper guide-curved surface portion that defines the curved surface of the upper guide that is convex toward the air outlet. The plurality of protrusions and the plurality of grooves may be disposed at the upper guide-straight surface portion.

In some examples, the upper guide-straight surface portion and the plurality of grooves may extend in a direction orthogonal to the rotational axis of the blowing fan, where a length of the plurality of grooves may be greater than or equal to a half of a length of the upper guide-straight surface portion in the direction orthogonal to the rotational axis of the blowing fan.

In some implementations, the upper guide and the air outlet may be spaced apart from each other along the discharge flow path, where the air conditioner further may include an extension guide that connects the downstream end of the upper guide and an upstream end of the air outlet.

In some implementations, the air conditioner may further include: a horizontal vane that extends in the left-right direction, that covers at least a portion of the air outlet, and is configured to control a direction of air discharged from the air outlet. In some implementations, the air conditioner may further include: a vertical vane that is connected to one of the upper guide or the lower guide, that extends from the upper guide or lower guide toward the discharge flow path, and that is configured to control a direction of air in the discharge flow path.

In some implementations, the heat exchanger may be disposed vertically between the air inlet and an upper portion of the blowing fan. In some examples, each of the plurality of protrusions is spaced apart from an upstream end of the upper guide by a first distance, where a ratio of the first distance with respect to a distance between the upstream end of the upper guide and the downstream end of the upper guide is in a range from 0.09 to 0.15.

In some implementations, each of the plurality of grooves may extend from a start end facing an upstream end of the upper guide to a finish end facing the downstream end of the upper guide, and each of the plurality of protrusions may be disposed between the start end and the upstream end of the upper guide.

In some implementations, the start end of each of the plurality of grooves may be spaced apart from the upstream end of the upper guide by a second distance, where a ratio of the second distance with respect to a distance between the upstream end of the upper guide and the downstream end of the upper guide is in a range from 0.15 to 0.2.

In some implementations, the finish end of each of the plurality of grooves is spaced apart from the upstream end of the upper guide by a third distance, where a ratio of the third distance with respect to a distance between the upstream end of the upper guide and the downstream end of the upper guide is in a range from 0.55 to 0.7.

The details of other implementations are included in the following description and the accompanying drawings.

In some implementations, as air is discharged through an upper side along an upper guide due to the Coanda effect at a downstream of the discharge flow path, there is an advantageous effect that air can be discharged by a long distance.

In some implementations, as a cross section of the discharge flow path increases toward the downstream, even though a vane is not formed horizontally at the air outlet, a cross section of the discharge flow path is not greatly decreased, and therefore, it may be possible to secure a predetermined amount of air flow to be discharged through the air outlet.

Effects of the present disclosure should not be limited to the aforementioned effects and other unmentioned effects will be clearly understood by those skilled in the art from the claims.

BRIEF DESCRIPTION OF THE DRAWINGS

One or more implementations will be described in detail with reference to the following drawings in which like reference numerals refer to like elements.

FIG. 5A shows an example of a wind direction of air discharged from an upper guide having no upper guide-curved surface portion, and FIG. 5B shows an example of a wind direction of air discharged from an upper guide having an upper guide-curved surface portion.

FIG. 8A shows an example of air flow in an upper guide having no groove, and FIG. 8B shows an example of air flow in an upper guide having grooves.

DETAILED DESCRIPTION

Figure 1:
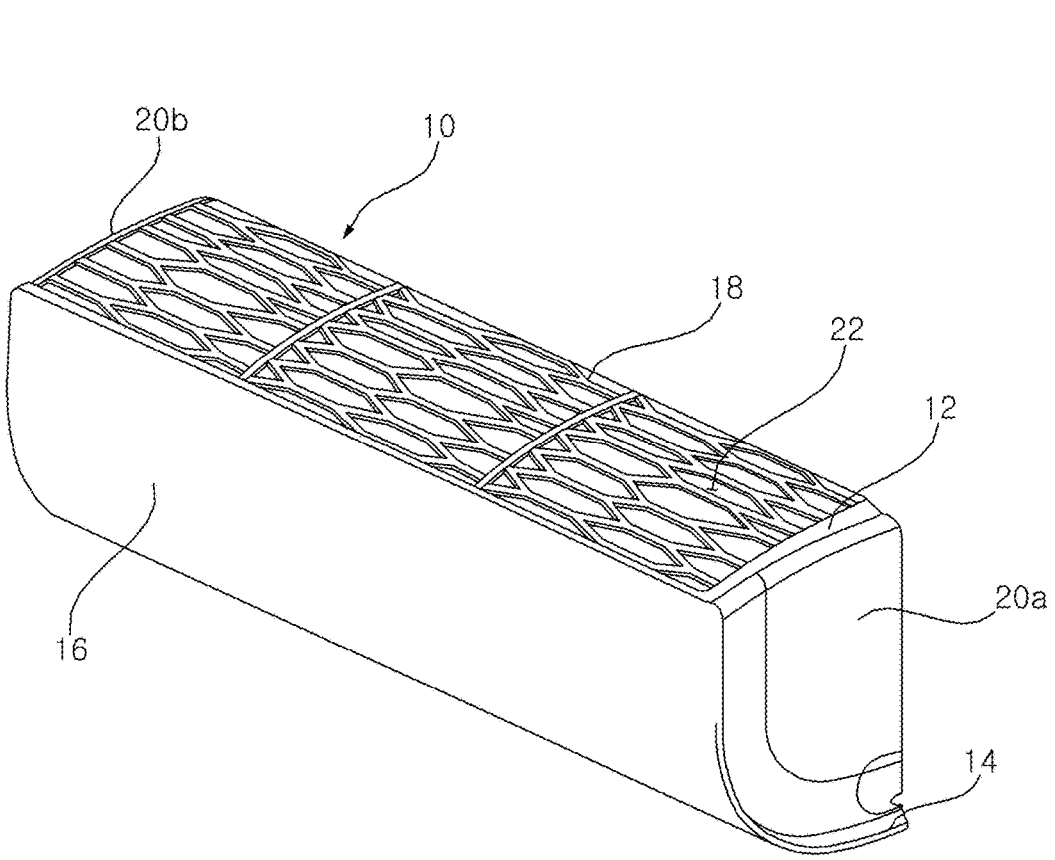
FIG. 1 is a perspective view showing an example of an air conditioner.

Advantages and features of the present disclosure and a method of achieving the same will be clearly understood from implementations described below in detail with reference to the accompanying drawings. However, the present disclosure is not limited to the following implementations and may be implemented in various different forms. The implementations are provided merely for complete disclosure of the present disclosure and to fully convey the scope of the disclosure to those of ordinary skill in the art to which the present disclosure pertains. The present disclosure may be defined by the scope of the claims. In the drawings, the thickness of layers and regions may be exaggerated for clarity. In some cases, the drawings may be drawn in scale to illustrate relative sizes between various parts. Throughout the drawings, like numbers refer to like elements.

Hereinafter, an air conditioner according to one or more implementations of the present disclosure will be described with reference to the accompanying drawings.

Figure 2:
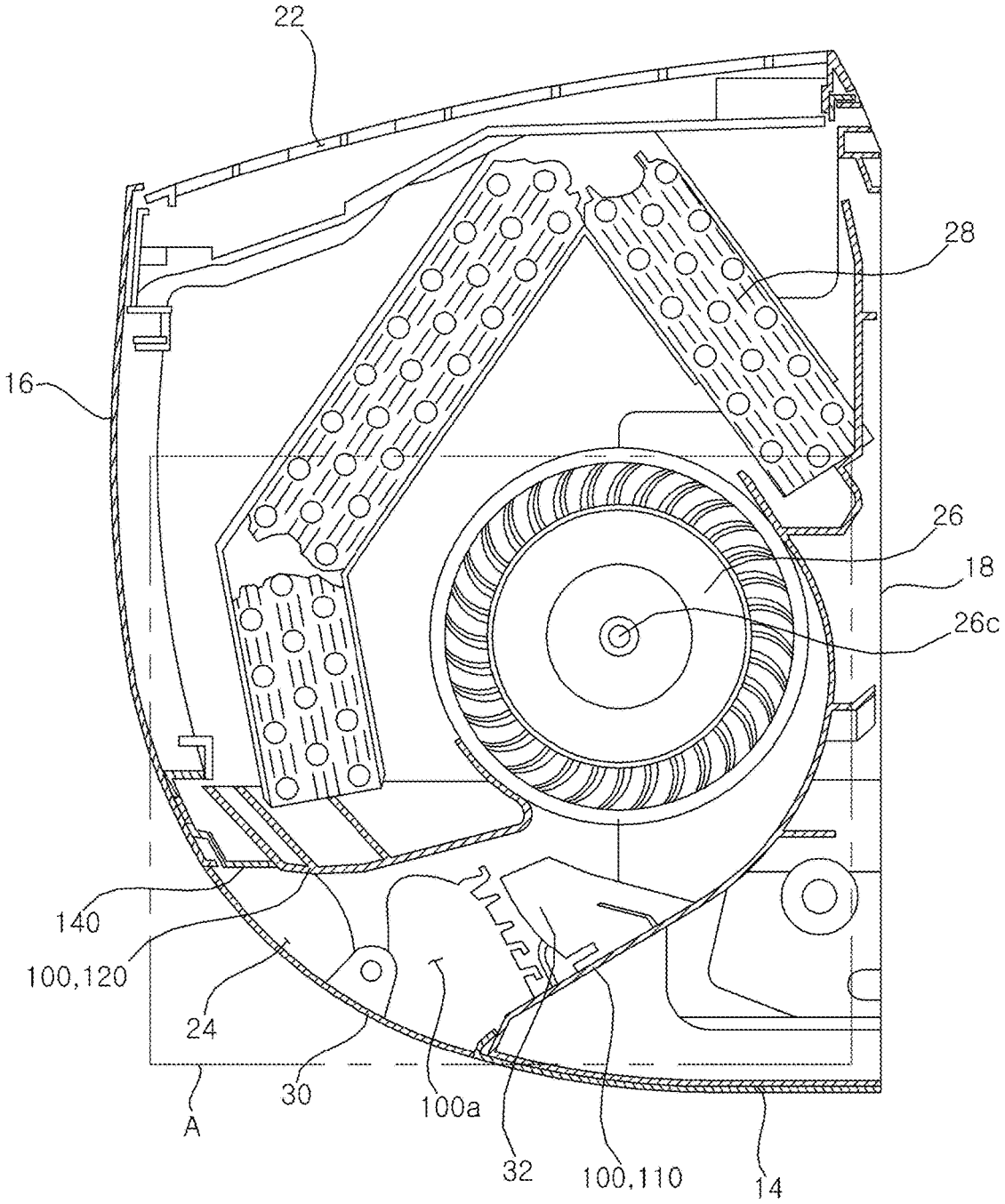
FIG. 2 is a side cross-sectional view showing an example of an air conditioner.

FIG. 1 is a perspective view showing an example of an air conditioner, and FIG. 2 is a side cross-sectional view showing an air conditioner.

Hereinafter, overall configuration of an air conditioner in one or more implementations will be described with reference to FIGS. 1 and 2.

In some implementations, an air conditioner 1 may include a housing 10 that defines an exterior appearance of the air conditioner and that defines an air inlet 22 and an air outlet 24, a heat exchanger 28 for heating or cooling air flowing inside the housing 10, a blowing fan 26 for allowing air inside the housing 10 to flow toward the air outlet 24, and a discharge guide 100 for guiding air blown by the blowing fan 26 toward the air outlet 24.

The housing 10 may define the air inlet 22 through which air is introduced or suctioned from above an upper surface 12 or a front surface 16, and the air outlet 24 through which air is discharged from below the front surface 16. In some examples, the housing 10 may have a rectangular shape that elongates in a left-right direction.

For example, a first length of the housing 10 defined along a first lateral direction (e.g., the left-right direction or a width direction) may be greater than a second length of the housing 10 defined along a second lateral direction (e.g., a front-back direction or a depth direction).

The air conditioner may refer to an indoor unit for a wall air conditioner, and the air outlet 24 may be disposed below the air inlet 22 so that air can flow from an upper side to a lower side inside the housing 10. In some implementations, the air inlet 22 may be disposed above the center of the blowing fan 26, and the air outlet 24 may be disposed below the center of the blowing fan 26.

In some implementations, an outer circumferential surface of the housing 10 may include a rear surface 18 that faces an indoor wall surface, an upper surface 12 that defines the air inlet 22 therein, the front surface 16 formed in a direction opposite to the rear surface 18, a lower surface 14 formed in a direction opposite to the upper surface 12, and both side surfaces 20*a* and 20*b* that are orthogonal to one or more of the front surface 16, the rear surface 18, the upper surface 12, and the lower surface 14.

In some implementations, the front surface 16 and the lower surface 14 may be gently continued in a curved surface shape, and the air outlet 24 is formed at a portion where the front surface 16 and the lower surface 14 are continued in the curved surface shape. The air outlet 24 may be formed in a front lower portion of the housing 10.

The housing 10 may define an interior space in which the heat exchanger 28 and the blowing fan 26 are disposed. Within the housing 10, a guide for guiding air suctioned through the air inlet 22 toward the blowing fan 26 or for guiding air flowing in the blowing fan 26 toward the air outlet 24 may be formed. Within the housing 10, a discharge guide 100 for guiding air flowing in the blowing fan 26 toward the air outlet 24 may be formed. Configuration and shape of the discharge guide 100 will be described later on in more detail.

The blowing fan 26 causes air introduced into the housing 10 through the air inlet 22 to flow toward the air outlet 24. In some implementations, the blowing fan 26 may be a cross flow fan, which suctions and discharges air in a direction vertical to a rotational axis direction of the blowing fan 26.

A center 26*c* of the blowing fan 26 is disposed below the air inlet 22. The center 26*c* of the blowing fan 26 may be disposed above the air outlet 24.

In some implementations, the blowing fan 26 may be disposed below the heat exchanger 28 to make air introduced into the housing 10 through the air inlet 22 and heat-exchanged with the heat exchanger 28 flow toward the air outlet 24.

In some implementations, the air conditioner 1 may further include a blowing fan motor disposed in one side of the blowing fan 26 and configured to rotate the blowing fan 26. For example, the blowing fan motor may include an electric motor configured to rotate the blowing fan about the rotational axis to cause air flow from the air inlet 22 to the air outlet 24.

The heat exchanger 28 may perform heat exchange with air flowing in the housing 10 to cool or heat the air. The heat exchanger 28 may perform heat exchange with air flowing in the housing 10, by condensing or evaporating a refrigerant flowing in the heat exchanger 28.

In some implementations, the heat exchanger 28 may be disposed between the blowing fan 26 and the air inlet 22 and performing heat exchange of outdoor air introduced through the air inlet 22. In some implementations, the heat exchanger 28 may be disposed in a direction in which outdoor air is allowed to be introduced from above the blowing fan 26 and flow toward the blowing fan 26.

In some implementations, the air conditioner 1 may further include a vane disposed in the air outlet 24 or in a discharge flow path 100*a* to guide a wind direction of discharged air.

In some implementations, the vane may include a horizontal vane 30 for controlling a wind direction of discharged air in an upward-downward direction, and a vertical vane 32 for controlling a wind direction of discharged air in a left-right direction.

The horizontal vane 30 is disposed at the air outlet 24 at an end of the discharge flow path 100*a*, and the vertical vane 32 may be disposed at a position deeper inside the housing 10 than the horizontal vane 30.

The vertical vane 32 may be rotatably connected to a vane fixing rib 134 protruding from an upper guide 120, which will be described later on, in a direction toward the discharge flow path. The vertical vane 32 may be rotatably connected to one side of a lower guide 110 which will be described later on.

Figure 3:
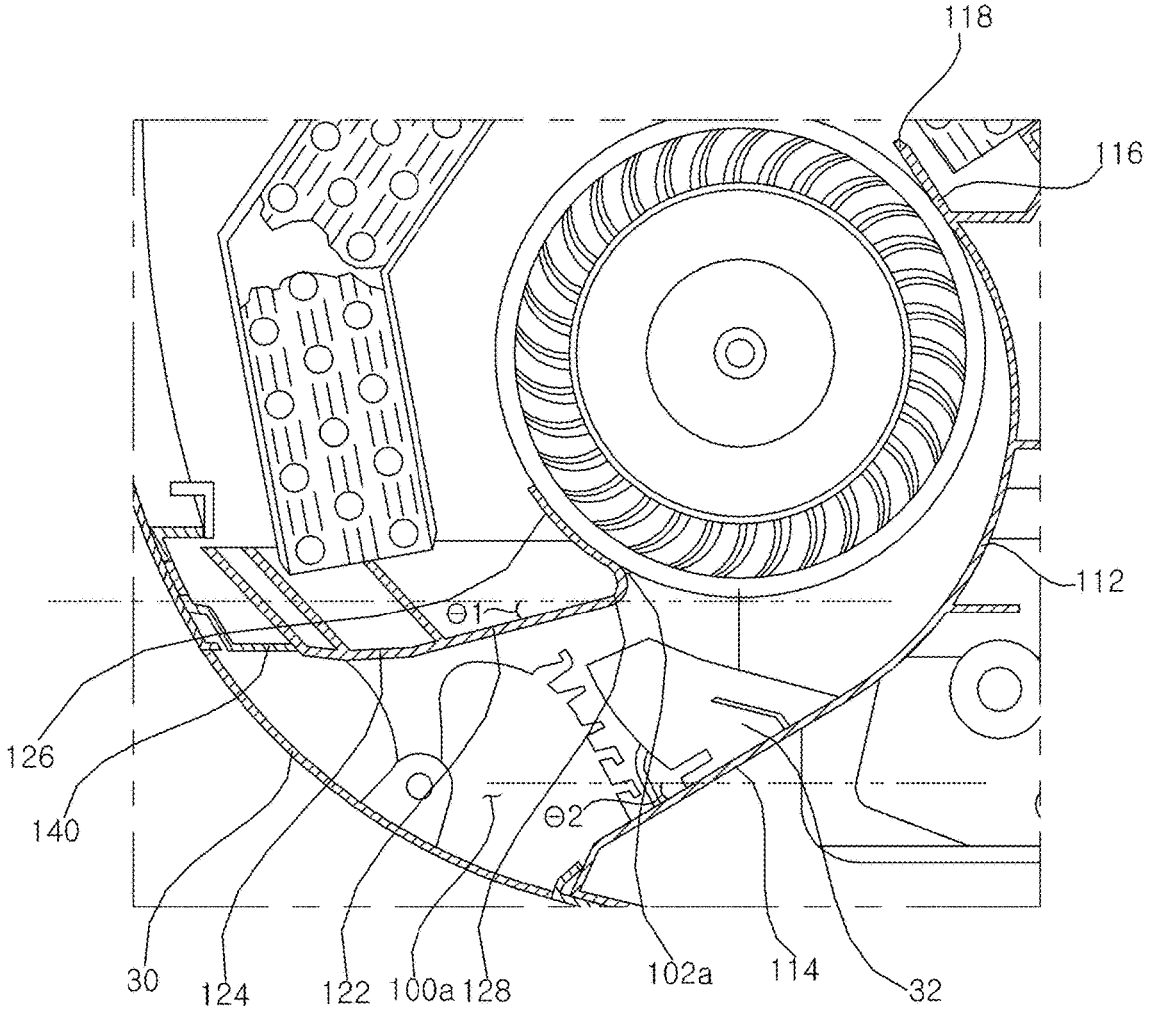
FIG. 3 is an enlarged cross-sectional view showing the portion A in FIG. 2.
Figure 4:
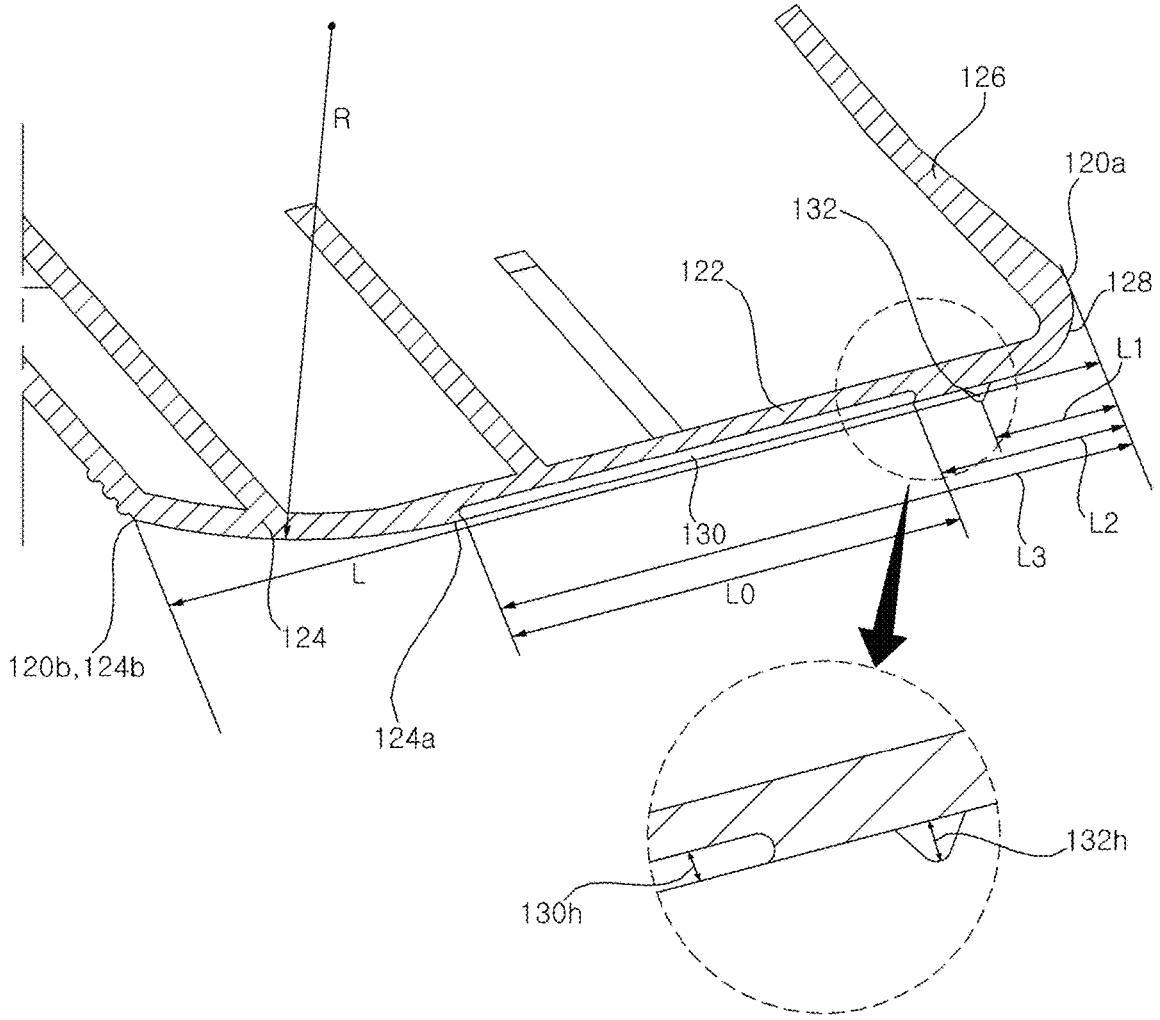
FIG. 4 is a cross-sectional view showing an example of an upper guide.
Figure 5A:
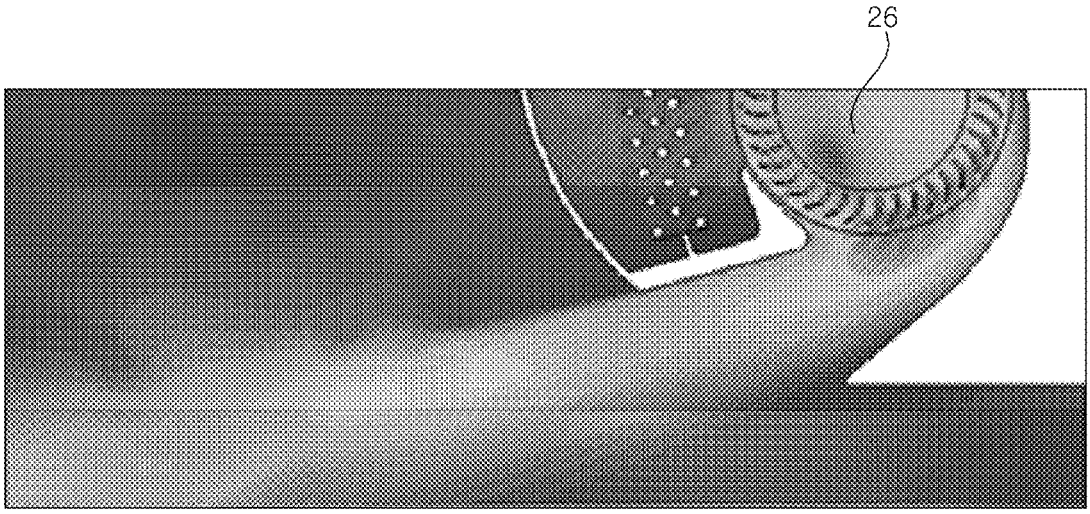
FIGS. 5A and 5B illustrate an example of a difference in a wind direction of air due to an upper guide-curved surface portion.
Figure 5B:
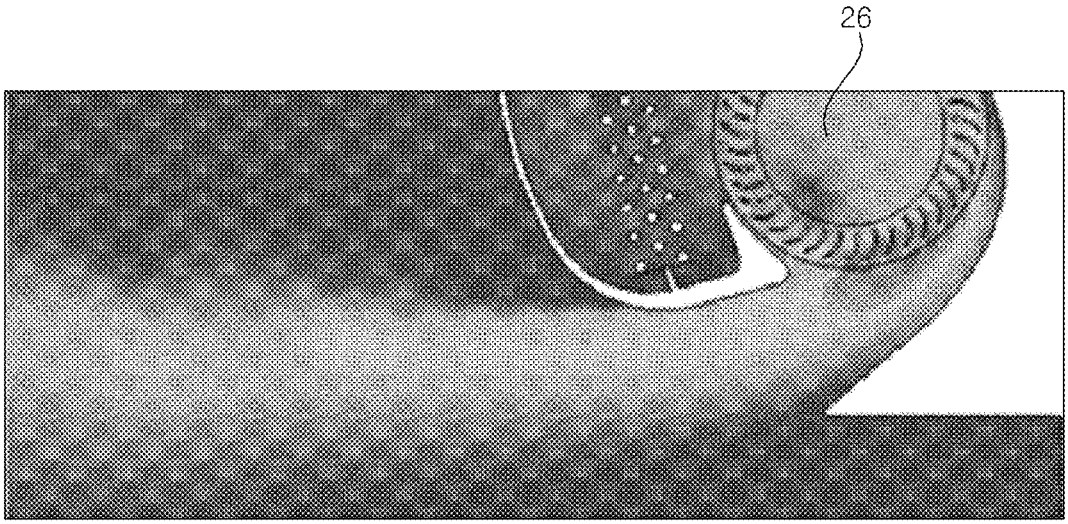
Figure 6:
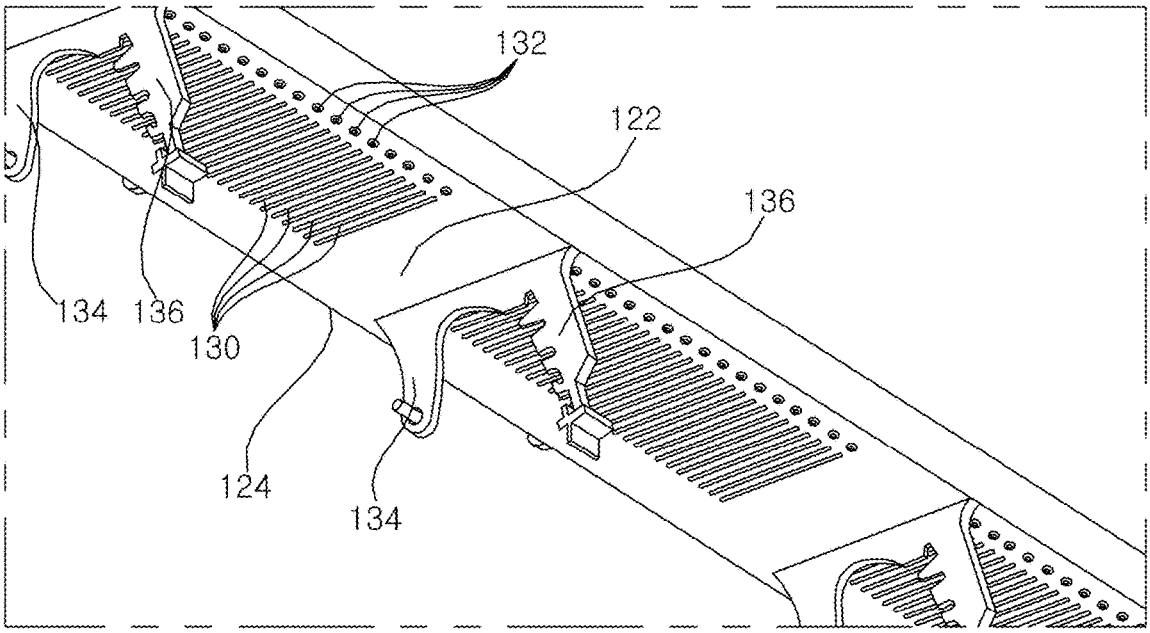
FIG. 6 is a perspective view showing example parts of an upper guide including a distance maintaining member and a vane fixing rib.
Figure 7:
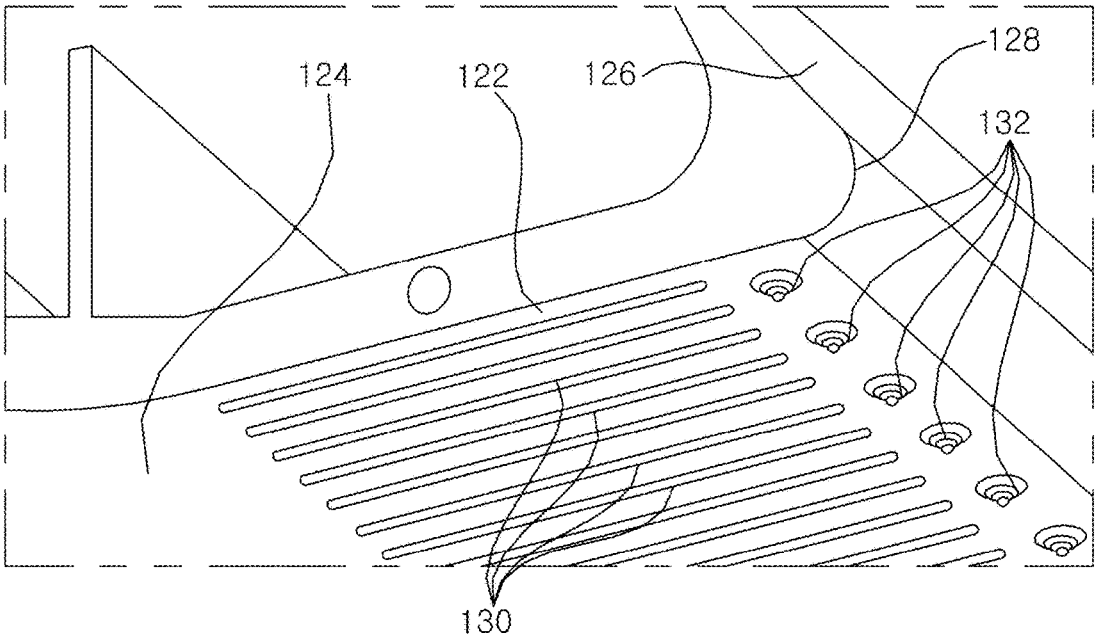
FIG. 7 is a perspective view showing an example part of an upper guide having a plurality of protrusions and a plurality of grooves.
Figure 8A:
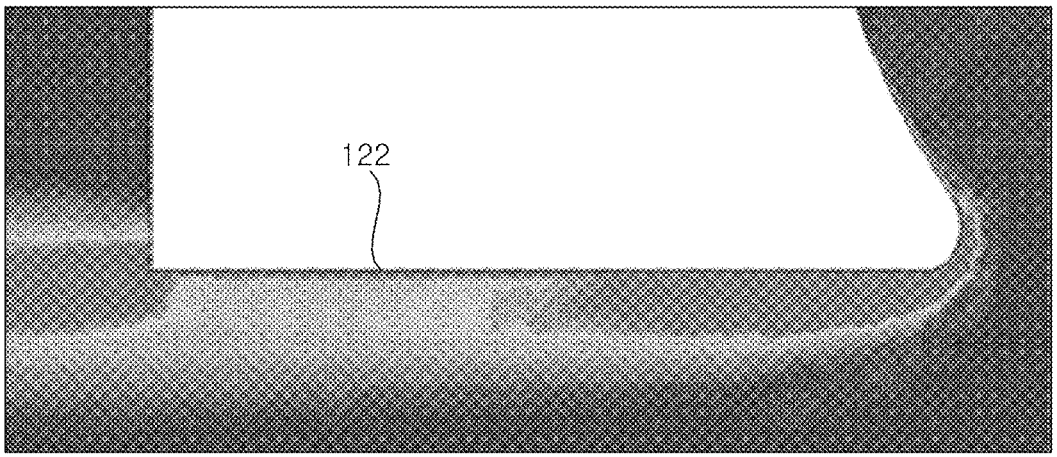
FIGS. 8A and 8B illustrate an example of a difference in flow separation caused by grooves in an upper guide of the present disclosure.
Figure 8B:
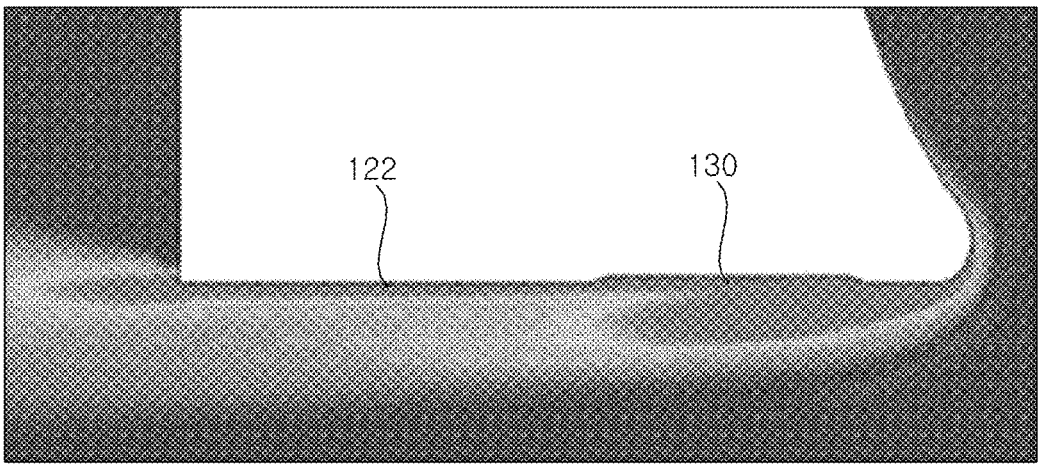
Figure 9:
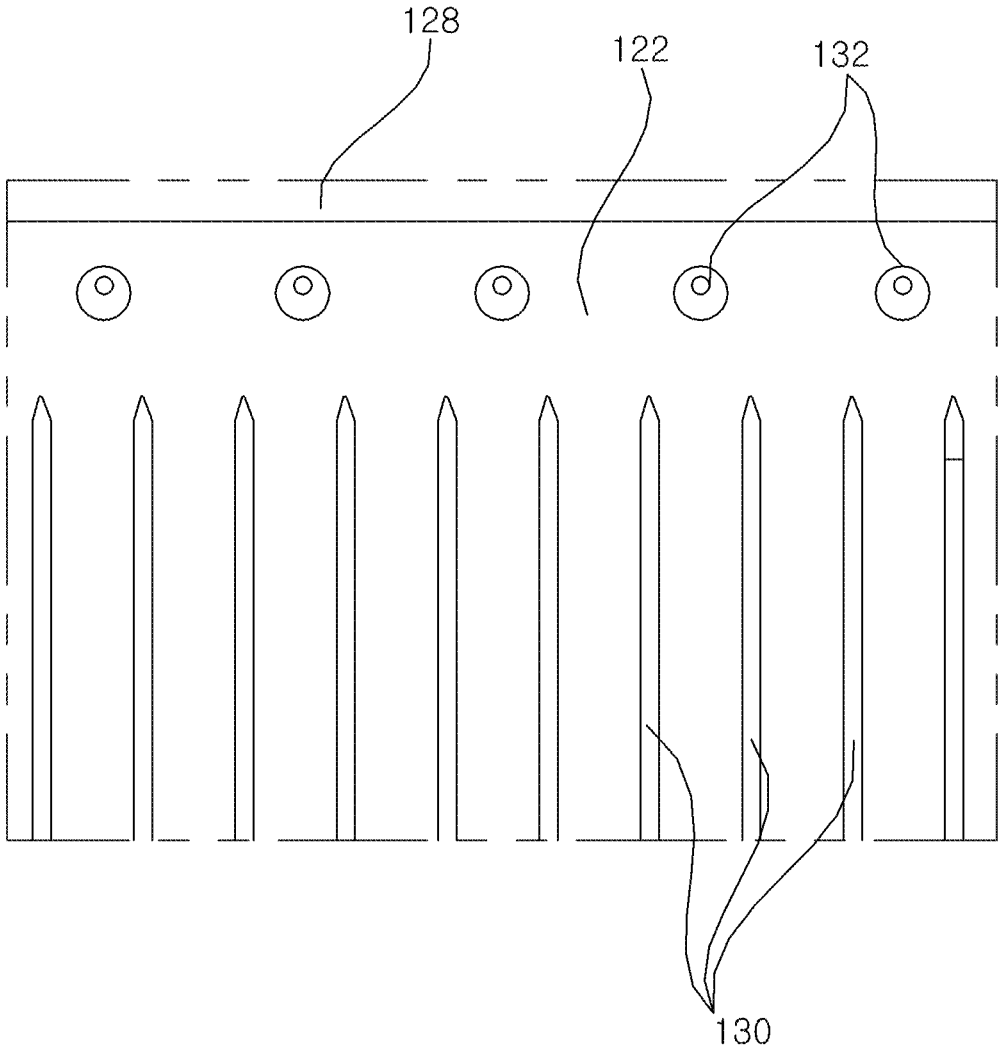
FIG. 9 illustrates an example of protrusions and grooves arranged in an upper guide.

FIG. 3 is an enlarged cross-sectional view showing the portion A in FIG. 2. FIG. 4 is a cross-sectional view of an example of an upper guide. FIGS. 5A and 5B illustrate an example of a difference of a wind direction of air due to the presence of an upper guide-curved surface portion of the present disclosure. In particular, FIG. 5A shows a wind direction of air discharged from an upper guide having no upper guide-curved surface portion, and FIG. 5B shows a wind direction of air discharged from an upper guide having an upper guide-curved surface portion. FIG. 6 is a perspective view showing example parts of an upper guide including a distance maintaining member and a vane fixing rib. FIG. 7 is a perspective view showing an upper guide having a plurality of protrusions and a plurality of grooves. FIGS. 8A and 8B illustrate examples of a difference in flow separation occurring due to grooves define at an upper guide. In particular, FIG. 8A shows an example of air flow in an upper guide having no groove, and FIG. 8B shows an example of air flow in an upper guide having grooves formed therein. FIG. 9 illustrates an example of protrusions and grooves arranged in an upper guide.

Hereinafter, referring to FIGS. 3 to 9, structure and shape of a discharge guide forming a discharge flow path of an air conditioner will be described.

The air conditioner 1 may include a discharge guide 100 for guiding air flowing by the blowing fan 26 toward the air outlet 24. In some implementations, the discharge guide 100 forms a discharge flow path 100*a* along which air flows by the blowing fan 26. The discharge guide 100 guides the air, flowing by the blowing fan 26, toward the air outlet 24.

In some implementations, the discharge guide 100 may include an upper guide 120 disposed above the discharge flow path 100*a*, and the lower guide 110 disposed below the discharge flow path 100*a*. The upper guide 120 is connected from a portion in front of the center 26*c* of the blowing fan 26 to an upper end of the air outlet 24. The lower guide 110 is connected from a rear portion behind the center 26*c* of the blowing fan 26 to a lower end of the air outlet 24.

The lower guide 110 includes a lower guide-curved surface portion 112, which is formed in a curved surface portion to guide air discharged by the blowing fan 26 from a rear side of the blowing fan 26 or a lower side of the blowing fan 26 toward the air outlet 24, and a lower guide-straight surface portion 114 which is formed in a straight surface portion extending from the lower guide-curved surface portion 112 toward the air outlet 24.

The lower guide-curved surface portion 112 may extend forming a curved surface portion from a partition portion 116 that is disposed the most adjacent to the center 26*c* of the blowing fan 26 toward a lower side. The partition portion 116 of the lower guide 110 disposed the most adjacent to the center 26*c* of the blowing fan 26 may be formed over a rear upper side of the blowing fan 26.

A portion of the lower guide-curved surface portion 112 from the partition portion 116 toward the air outlet 24 is formed to be gradually spaced apart from the center 26*c* of the blowing fan 26. That is, a radius of curvature of the lower guide-curved surface portion 112 is formed to be greater than a radius of curvature of the blowing fan 26.

In some implementations, the lower guide-curved surface portion 112 may extend to a lower rear side of the blowing fan 26. Air flowing by the blowing fan 26 may be reflected by the lower guide-curved surface portion 112 and then flow toward the upper guide 120.

In some examples, the lower guide-straight surface portion 114 may seamlessly extend from the lower guide-curved surface portion 112. Accordingly, the lower guide-straight surface portion 114 may extend at an angle of inclination formed by the end of the lower guide-curved surface portion 112. The lower guide-straight surface portion 114 may form an angle of inclination in such a way that the end of the lower guide-straight surface portion 114 faces a front lower side.

The lower guide 110 may include a lower guide-upper end 118 extending upward from the partition portion 116 disposed the most adjacent to the center 26*c* of the blowing fan 26. The lower guide-upper end 118 may extend toward above the blowing fan 26, and guide air to be suctioned into the blowing fan 26.

The upper guide 120 forms the discharge flow path 100*a* with the lower guide 110, and the upper guide 120 is disposed to face the lower guide 110. The upper guide 120 includes an upper guide-straight surface portion 122, forming a straight surface portion at an upper stream side of the discharge flow path 100*a*, and an upper guide-curved surface portion 124, extending from the upper guide-straight surface portion 122 toward the air outlet 24 and forming a curved surface portion convex toward the air outlet 24.

In some implementations, the upper guide-straight surface portion 122 may form the discharge flow path 100*a* with the lower guide-straight surface portion. An angle θ1 of inclination between the upper guide-straight surface portion 122 and a virtual horizontal line formed in a front-back direction is smaller than an angle θ2 of inclination between the lower guide-straight surface portion 114 and the virtual horizontal line. In other words, the second inclination angle θ2 with respect to the horizontal line may be greater than the first inclination angle θ1 with respect to the horizontal line.

In some implementations, the upper guide-straight surface portion 122 is elongated in a direction in which air flows. A plurality of grooves 130 forming recessed portions inwardly of the upper guide-straight surface portion 122 may be formed. The plurality of grooves 130 may be arranged at a predetermined interval from each other in an axial direction of the blowing fan 26.

The plurality of grooves 130 may suppress flow separation that occurs by air flowing along the upper guide-straight surface portion 122. That is, it is possible to minimize an increase of flow friction caused by an increased flow rate of air flowing along the upper guide-straight surface portion 122.

The plurality of grooves 130 may be formed in a length L0 equal to or greater than half a length L3 formed by the upper guide-straight surface portion 122 along the discharge flow path 100*a*. In some examples, a depth 130*h* of recessed portions formed inwardly of the upper guide-straight surface portion 122 by the plurality of grooves 130 may be maintained constant along the length of a corresponding groove. In another implementation, the depth 130*h* may increase or decrease in a direction in which air flows.

In some implementations, the upper guide-straight surface portion 122 may further include a plurality of protrusions 132 arranged along an axial direction of the blowing fan 26. The plurality of protrusions 132 may protrude downward from a surface of the upper guide-straight surface portion 122 facing toward the lower guide 110. The plurality of protrusions 132 may suppress a vortex occurring in air that flows along the discharge flow path 100*a*.

In the upper guide-straight surface portion 122, the plurality of protrusions 132 may be disposed at an upper stream side than the plurality of grooves 130. The plurality of protrusions 132 may be disposed more adjacent to the blowing fan 26 than the plurality of grooves 130. Thus, air flowing in the discharge flow path 100*a* by the blowing fan 26 may flow to the plurality of grooves 130 after passing through the plurality of protrusions 132.

In some implementations, an interval 132*d* between adjacent protrusions among the plurality of protrusions 132 is greater than an interval 130*d* between adjacent grooves among the plurality of grooves 130. In some implementations, two grooves 130 are arranged between two protrusions adjacent to the axial direction of the blowing fan 26. In some implementations, a height 132*h* by which the protrusions 132 protrude from the upper guide-straight surface portion 122 is greater than a depth 130*h* of recessed portions formed inwardly of the upper guide-straight surface portion 122 by the grooves 130.

The upper guide-curved surface portion 124 extends from the upper guide-straight surface portion 122 toward the air outlet 24, and forms a curved surface portion convex in a direction toward the air outlet 24. For example, an inclined surface defined by an upstream end 124*a* of the upper guide-curved surface portion 124 may be inclined further below than a virtual horizontal line or plane that extends a front-back direction. An inclined surface defined by a downstream end 124*b* may be parallel to the virtual horizontal line or may be inclined further above than the horizontal line. The horizontal line or plane may pass through a portion of the upper guide-curved surface portion 124 between the upstream end 124*a* and the downstream end 124*b*.

In some examples, the downstream end 124*b* of the upper guide-curved surface portion 124 disposed adjacent to the air outlet 24 may be inclined upwardly than the virtual horizontal line or may define an inclined surface in the same direction as that of the virtual horizontal line.

Thus, an extension degree of a cross section of the discharge flow path 100*a* formed between the upper guide-curved surface portion 124 and the lower guide-straight surface portion 114 is greater than an extension degree of the discharge flow path 100*a* formed between the upper guide-straight surface portion 122 and the lower guide-straight surface portion 114.

The curved surface structure formed by the upper guide-curved surface portion 124 may improve pressure recovery of the air outlet 24 and thereby increase an amount of air flow.

In some implementations, the upper guide-curved surface portion 124 may form an upward wind direction so that air can be upwardly discharged through the air outlet 24. That is, due to the Coanda effect, air flowing along the upper guide-straight surface portion 122 flows along a surface formed by the upper guide-curved surface portion 124, and therefore, a discharge direction may be formed upwardly. Thus, as a wind direction of air to be discharged from the air outlet 24 is formed upwardly, the upper guide-curved surface portion 124 can discharge air from the air conditioner 1 by a long distance.

In some implementations, the upper guide 120 includes an upper guide-upper end 126 guiding a part of the air discharged from the blowing fan 26 toward the blowing fan 26 again, and a connecting portion 128 connecting the upper guide-upper end 126 and the upper guide-straight surface portion 122.

The upper guide-upper end 126 extends to be closer toward the center of the blowing fan 26 along an outer circumferential surface of the blowing fan 26. The upper guide-upper end 126 is disposed as close as possible to the blowing fan 26 in such a way to minimize an amount of air flow that is discharged from the blowing fan 26 and then flows in reverse back to the blowing fan 26. An angle between the upper guide-upper end 126 and the upper guide-straight surface portion 122 may form an acute angle smaller than a right angle. The connecting portion 128 may gently bend in such a way to minimize a vortex of air discharged from the blowing fan 26, which occurs between the discharge flow path 100*a* and a reverse flow path 102*a*.

In some implementations, the upper guide 120 may be spaced apart from an upper end of the air outlet 24 at a predetermined interval, and the upper guide 120 may further include an extension guide 140 that connects the upper end of the air outlet 24 and the upper guide 120. The extension guide 140 may maintain an extension degree of a cross section of the discharge flow path 100*a* extended by the upper guide-curved surface portion 124. The extension guide 140 connects the downstream end 124*b* of the upper guide-curved surface portion 124 and the upper end of the air outlet 25.

The extension guide 140 may form a straight surface along the discharge flow path 100*a*. The extension guide 140 may maintain an inclined surface formed upwardly along the upper guide-curved surface portion 124.

In some implementations, grooves and protrusions may be formed even in the extension guide 140 to increase an amount of air to be discharged through the air outlet 24.

In some implementations, the upper guide 120 may further include an interval maintaining member 136 for maintaining an interval between the upper guide 120 and the lower guide 110, and the vane fixing rib 134 for rotatably fixing the horizontal vane 30.

The interval maintaining member 136 may protrude from the upper guide 120 toward the discharge flow path 100*a* and be connected to the lower guide 110. In the interval maintaining member 136, a plurality of damping grooves may be formed to alleviate vibration occurring due to rotation of the blowing fan 26 disposed above the upper guide 120 in the housing 10. The vane fixing rib 134 may protrude from the upper guide 120 toward the air outlet 24, and may be rotatably fixed to the horizontal vane 30 at an end thereof.

In some implementations, the interval maintaining member 136 and the vane fixing rib 134 may be provided in plural at a predetermined interval along the rotational axis direction of the blowing fan 26. A plurality of protrusions and a plurality of grooves may be formed between the plurality of interval maintaining members 136 and a plurality of vane fixing ribs 134.

Figure 10:
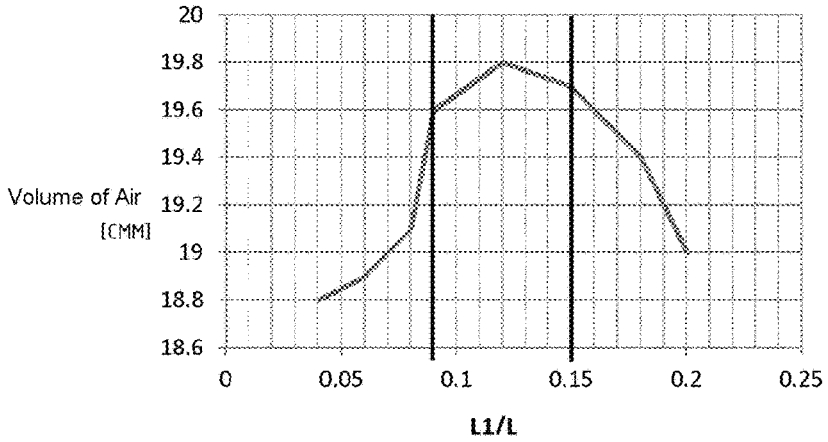
FIG. 10 is a graph showing an example of a relationship between arrangement of protrusions on an upper guide of an air conditioner and an amount of air discharged through an air outlet.
Figure 11:
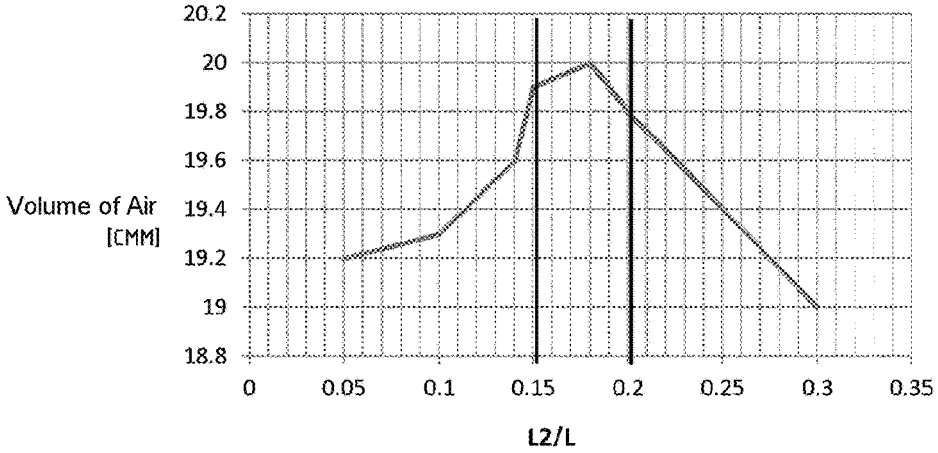
FIG. 11 is a graph showing an example of a relationship between arrangement of a start portion of a groove in an air conditioner and an amount of air discharged through an air outlet.
Figure 12:
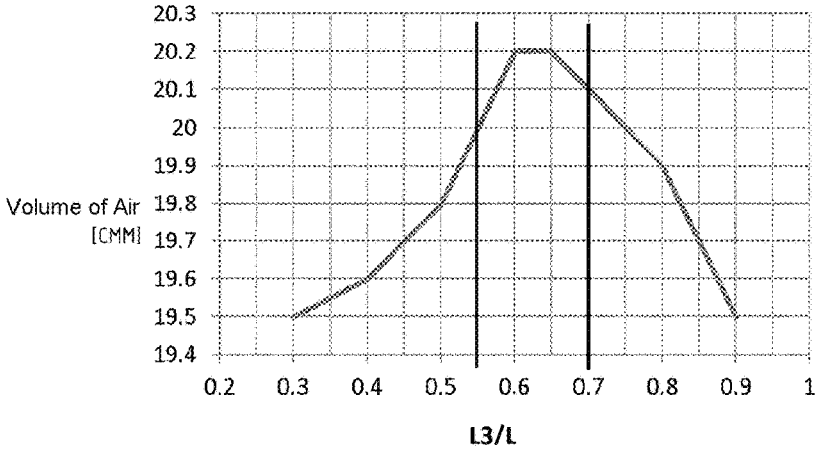
FIG. 12 is a graph showing an example of a relationship between arrangement of a finish end of a groove in an air conditioner and an amount of air discharged through an air outlet.
Figure 13:
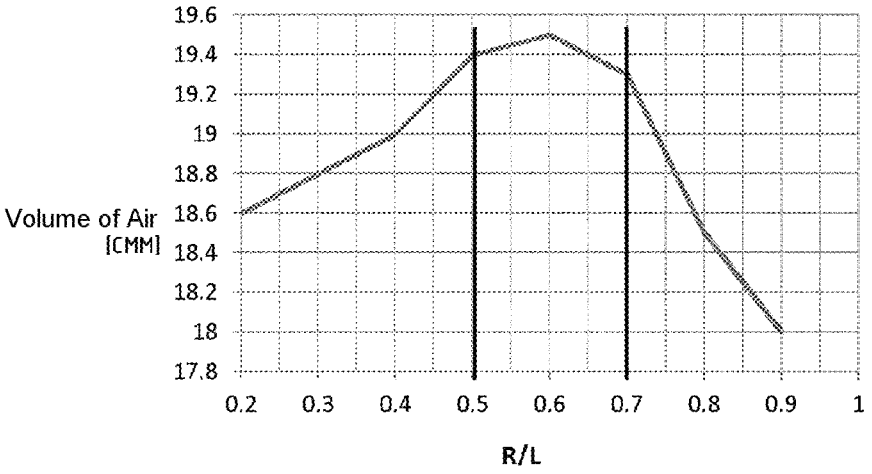
FIG. 13 is a graph showing an example of an amount of air to be discharged through an air outlet depending on a relationship between a length of an upper guide and a radius of curvature of an upper guide-curved surface portion.

FIG. 10 is a graph showing an example of a relationship between an arrangement of protrusions and an upper guide of an air conditioner and an amount of air discharged through an air outlet. FIG. 11 is a graph showing an example of a relationship between an arrangement of a start portion of a groove and an amount of air discharged through an air outlet. FIG. 12 is a graph showing an example of a relationship between an arrangement of a finish end of a groove in an air conditioner and an amount of air discharged through an air outlet. FIG. 13 is a graph showing an example of an amount of air to be discharged through an air outlet depending on a relationship between a length of an upper guide and a radius of curvature of an upper guide-curved surface portion.

Hereinafter, examples of relationship between elements of the upper guide and an amount of air to be discharged through an air outlet will be described with reference to FIGS. 10 to 13.

For example, the protrusions 132 may be spaced apart by a predetermined interval or distance from the upstream end 120*a* of the upper guide 120 in consideration of the following: a shape and arrangement of the upper guide-upper end 126 and the connecting portion 128 and occurrence of a vortex of air flowing along the upstream of the upper guide-straight surface portion 122.

Referring to FIG. 10, in a range where a first preset interval L1 is between 0.09 times and 0.15 times of a length L of the upper guide 120, an amount of discharged air flow reaches a predetermined level or higher. Here, the length L of the upper guide 120 may be defined as a distance from the upstream end 120*a* to the downstream end 120*b* of a line formed along the upper guide-straight surface portion 122.

That is, the plurality of protrusions 132 may be spaced apart at a first preset interval L1 from the upstream end 120*a* of the upper guide 120. The first preset interval L1 may be greater than 0.09 times of the length L of the upper guide 120 and smaller than 0.15 times of the length L of the upper guide 120. In other words, each of the plurality of protrusions 132 may be spaced apart from the upstream end 120*a* of the upper guide 120 by a first distance L1. In some implementations, a ratio of the first distance with respect to a distance between the upstream end 120*a* of the upper guide and the downstream end 120*b* of the upper guide may be in a range from 0.09 to 0.15.

Arrangement of the grooves 130 in the upper guide-straight surface portion 122 may be set by taking into consideration the following: a length of the upper guide-straight surface portion 122 and a timing of when flow separation occurs in air flowing along the upper guide 120.

Referring to FIG. 11, in a range where a second preset interval L2 from the upstream end 120*a* of the upper guide 120 to the start end of the groove 130 is between 0.15 times and 0.2 times of the length L of the upper guide 120, an amount of discharged air flow reaches a predetermined level or higher.

In other words, the start end of each of the plurality of grooves 130 may be spaced apart from the upstream end 120*a* of the upper guide 120 by a second distance L2. In some implementations, a ratio of the second distance with respect to a distance between the upstream end 120*a* of the upper guide and the downstream end 120*b* of the upper guide may be in a range from 0.15 to 0.2

Referring to FIG. 12, in a range where a third preset interval L3 between the upstream end 120*a* of the upper guide 120 and a finish end of the groove 130 is between 0.55 times and 0.7 times of the length L of the upper guide 120, an amount of discharged air flow reaches a predetermined level or higher. In other words, the finish end of each of the plurality of grooves 120 may be spaced apart from the upstream end 120*a* of the upper guide by a third distance L3. In some implementations, a ratio of the third distance with respect to a distance between the upstream end 120*a* of the upper guide and the downstream end 120*b* of the upper guide may be in a range from 0.55 to 0.7.

In some implementations, the second preset interval L2 may be greater than 0.15 times of the length L of the upper guide 120 and smaller than 0.2 times of the length L of the upper guide 120. In addition, the third preset interval L3 may be greater than 0.55 times of the length L of the upper guide and smaller than 0.7 times of the length L of the upper guide 120.

A radius R of curvature formed by the upper guide-curved surface portion 124 may be set by taking into consideration the following: a structure where a wind direction can be set to cause discharged air to flow upwardly, and a range where air flowing along the upper guide-curved surface portion 124 can have the Coanda effect.

Referring to FIG. 12, in a range where the radius R of a curvature structure formed by the upper guide-curved surface portion 124 is between 0.5 times and 0.7 times of the length L of the upper guide 120, an amount of discharged air flow reaches a predetermined level or higher.

That is, the radius R of a curvature structure formed by the upper guide-curved surface portion 124 may be greater than 0.5 times the length L of the upper guide 120 and less than 0.7 times the length L of the upper guide 120.

Although one or more example implementations of the present disclosure have been disclosed for illustrative purposes, those skilled in the art will appreciate that various modifications, additions and substitutions are possible, without departing from the scope and spirit of the disclosure as disclosed in the accompanying claims. Accordingly, such modifications, additions and substitutions should also be understood to fall within the scope of the present disclosure.

What is claimed is:

1. An air conditioner comprising:

a housing that defines an air inlet and an air outlet disposed vertically below the air inlet;

a heat exchanger configured to exchange heat with air introduced into the housing through the air inlet;

a blowing fan that is disposed inside the housing, that is disposed at an upper rear side of the air outlet, and that is configured to rotate about a rotational axis that extends in a left-right direction of the housing to cause air introduced through the air inlet to flow toward the air outlet;

a lower guide configured to guide, toward the air outlet, air discharged to a rear side of the blowing fan and a lower side of the blowing fan; and an upper guide that is disposed above the lower guide and that defines a discharge flow path with the lower guide, the discharge flow path extending from the blowing fan to the air outlet, wherein a cross sectional area of the discharge flow path increases toward the air outlet, wherein the upper guide comprises:

an upper guide-straight surface portion that defines a planar surface at an upstream side of the discharge flow path, an upper guide-curved surface portion that extends from the upper guide-straight surface portion toward the air outlet and that defines a curved surface of the upper guide convex toward the air outlet, an upper guide-upper end that extends along an outer circumferential surface of the blowing fan, a connecting portion that connects the upper guide-straight surface portion to the upper guide-upper end, a plurality of protrusions that are disposed at the upstream side of the discharge flow path, that protrude from a surface of the upper guide toward the discharge flow path, and that are spaced apart from each other along a direction parallel to the rotational axis of the blowing fan, and a plurality of grooves that are recessed inward from the upper guide-straight surface portion and extend along the discharge flow path, and wherein the plurality of grooves are spaced apart from the plurality of protrusions in a direction parallel to the discharge flow path and disposed downstream relative to the plurality of protrusions along the discharge flow path.

2. The air conditioner of claim 1, wherein the lower guide comprises:

a lower guide-curved surface portion that defines a curved surface configured to guide, toward the air outlet, air discharged from the blowing fan toward the rear side of the blowing fan or the lower side of the blowing fan; and a lower guide-straight surface portion that defines a planar surface that extends from the lower guide-curved surface portion toward the air outlet.

3. The air conditioner of claim 2, wherein the upper guide-straight surface portion defines a first inclination angle with respect to a horizontal line that extends in a front-back direction of the housing, and wherein the lower guide-straight surface portion defines a second inclination angle with respect to the horizontal line, the second inclination angle being greater than the first inclination angle.

4. The air conditioner of claim 2, wherein the upper guide-curved surface portion has a first end that is adjacent to the air outlet and that is disposed vertically above a virtual horizontal plane that extends in a front-back direction of the housing.

5. The air conditioner of claim 4, wherein the upper guide-curved surface portion has a second end that is connected to the upper guide-straight surface portion and that is disposed vertically below the virtual horizontal plane.

6. The air conditioner of claim 1, wherein a protrusion height of each of the plurality of protrusions with respect to the surface of the upper guide is greater than a recess depth of each of the plurality of grooves with respect to the surface of the upper guide.

7. The air conditioner of claim 1, wherein two grooves of the plurality of grooves are arranged between two adjacent protrusions among the plurality of protrusions.

8. The air conditioner of claim 1, wherein the upper guide-straight surface portion and the plurality of grooves extend in a direction orthogonal to the rotational axis of the blowing fan, and wherein a length of the plurality of grooves is greater than or equal to a half of a length of the upper guide-straight surface portion in the direction orthogonal to the rotational axis of the blowing fan.

9. The air conditioner of claim 1, wherein the upper guide and the air outlet are spaced apart from each other along the discharge flow path, and wherein the air conditioner further comprises an extension guide that connects a downstream end of the upper guide and an upstream end of the air outlet.

10. The air conditioner of claim 1, further comprising:

a horizontal vane that extends in the left-right direction, that covers at least a portion of the air outlet, and is configured to control a direction of air discharged from the air outlet.

11. The air conditioner of claim 1, further comprising:

a vertical vane that is connected to one of the upper guide or the lower guide, that extends from the upper guide or the lower guide toward the discharge flow path, and that is configured to control a direction of air in the discharge flow path.

12. The air conditioner of claim 1, wherein the heat exchanger is disposed vertically between the air inlet and an upper portion of the blowing fan.

13. The air conditioner of claim 1, wherein each of the plurality of protrusions is spaced apart from an upstream end of the upper guide by a first distance, and wherein a ratio of the first distance with respect to a distance between the upstream end of the upper guide and a downstream end of the upper guide is in a range from 0.09 to 0.15.

14. The air conditioner of claim 1, wherein each of the plurality of grooves extends from a start end facing an upstream end of the upper guide to a finish end facing a downstream end of the upper guide, and wherein each of the plurality of protrusions is disposed between the start end and the upstream end of the upper guide.

15. The air conditioner of claim 14, wherein the start end of each of the plurality of grooves is spaced apart from the upstream end of the upper guide by a second distance, and wherein a ratio of the second distance with respect to a distance between the upstream end of the upper guide and the downstream end of the upper guide is in a range from 0.15 to 0.2.

16. The air conditioner of claim 14, wherein the finish end of each of the plurality of grooves is spaced apart from the upstream end of the upper guide by a third distance, and wherein a ratio of the third distance with respect to a distance between the upstream end of the upper guide and the downstream end of the upper guide is in a range from 0.55 to 0.7.

17. The air conditioner of claim 1, wherein the plurality of grooves are arranged along the upper guide-straight surface portion and spaced apart from one another in a direction crossing the discharge flow path, and wherein the plurality of grooves are configured to guide air along the discharge flow path and to suppress a flow separation of the air to thereby reduce a flow friction on the upper guide-straight surface portion.

18. The air conditioner of claim 1, wherein a recess depth of each of the plurality of grooves is less than a thickness of the upper guide-straight surface portion.

19. The air conditioner of claim 1, wherein upstream ends of the plurality of grooves are disposed downstream relative to downstream ends of the plurality of protrusions.

20. The air conditioner of claim 19, wherein the plurality of grooves are disposed upstream relative to the upper guide-curved surface portion along the discharge flow path, and wherein the plurality of protrusions are disposed between the connecting portion and the upstream ends of the plurality of grooves along the discharge flow path.

* * * * *